US006732861B2

(12) United States Patent
Aarts

(10) Patent No.: US 6,732,861 B2
(45) Date of Patent: May 11, 2004

(54) SAFETY PACKING FOR A PRODUCT TO BE EXHIBITED

(75) Inventor: Mathieu Aarts, Maastricht (NL)

(73) Assignee: Norsk Hydro, Oslo (NO)

( * ) Notice: Subject to any disclaimer, the term of this patent is extended or adjusted under 35 U.S.C. 154(b) by 0 days.

(21) Appl. No.: 10/203,239

(22) PCT Filed: Jan. 30, 2001

(86) PCT No.: PCT/EP01/01020

§ 371 (c)(1),
(2), (4) Date: Oct. 9, 2002

(87) PCT Pub. No.: WO01/59240

PCT Pub. Date: Aug. 16, 2001

(65) Prior Publication Data

US 2003/0051517 A1 Mar. 20, 2003

(30) Foreign Application Priority Data

Feb. 7, 2000 (NL) ..... 1014308

(51) Int. Cl.[7] ..... B65D 85/57
(52) U.S. Cl. ..... 206/308.2; 206/1.5
(58) Field of Search ..... 206/308.2, 308.1, 206/307, 309, 1.5, 807, 818, 387.11

(56) References Cited

U.S. PATENT DOCUMENTS 5,524,752 A * 6/1996 Mazzucchelli ..... 206/308.2
5,904,246 A * 5/1999 Weisburn et al. ..... 206/308.2
6,336,554 B1 * 1/2002 Bruhwiler ..... 206/308.2

* cited by examiner

*Primary Examiner*—Jacob K. Ackun
(74) *Attorney, Agent, or Firm*—Hartman & Hartman; Gary M. Hartman; Domenica N. S. Hartman

(57) ABSTRACT

A safety packing for a product to be exhibited, such as a CD packing. The safety packing comprises a housing with an opening through which the product can be inserted into and removed from the safety packing, and a locking mechanism associated with the housing for preventing removal of the product from the housing through the opening. The locking mechanism comprises a frame connected to the housing and a locking element received in the frame. The locking element is movable between a locking position where the product is prevented from being removed from the housing, and an open position toward which the locking element is biased to allow the product to be moved into and from the housing through the opening. The locking mechanism further comprises a retainer that is biased toward a retaining position and movable to a release position through application of a magnetic force, so as to release the locking element from the locking position. An opening is provided in the locking mechanism for receiving a magnetic element operable to generate the magnetic force necessary to move the retainer from the retaining position to the release position.

12 Claims, 2 Drawing Sheets

SAFETY PACKING FOR A PRODUCT TO BE EXHIBITED

CROSS REFERENCE TO RELATED APPLICATIONS

This application claims the benefit of International Application No. PCT/EP01/01020, filed Jan. 30, 2001, having a priority claim to Netherlands patent application number 1014308, filed Feb. 7, 2000.

BACKGROUND OF THE INVENTION

The present invention relates to a safety packing for a product to be exhibited, for example, a CD packing, comprising a housing for keeping the product, with an opening for inserting or removing the product and a locking mechanism comprising a frame part which is securely connected with the housing and a locking element to be moved between two positions, namely a locking position where the product may be prevented from being moved into and from the housing, and an open position where the product may be moved into and from the housing, wherein the locking element is pushed through a spring in the direction of the open position, and a retainer which is movable between a retaining position and a release position, which retainer is pushed in the retaining position through a spring, wherein the retainer in the retaining position secures the locking element when this latter is in the locking position relative to the frame part, which retainer can be moved against the spring load through a magnetic force towards the release position in order to let the locking element move freely.

Such a packing is known from WO-A-98 36 997.

In such a known packing, the retainer is formed by saw tooth-shaped clamps which are connected to the movable locking element and can be pressed onto resilient metal bands, which, after the clamps have completely passed thereon, return to their initial position and therefore, maintain the locking element in the closed position. The resilient bands can thereby move in an area which is approximately perpendicular to the moving direction of the movable locking element. For moving the locking element, a single magnet being mounted in the vicinity of the metal bands is sufficient, whereby the bands can be shifted against their own spring load and the clamps released, resulting in the locking element being moved with the spring load to the release position.

Such a known packing has this disadvantage that the magnetic force which is necessary to release the locking element is generated by a magnet or a magnetized material which is kept against the packing outside at the right place. Consequently, it is quite easy to remove the product from the safety packing, as a potential shop-lifter could simply open such a safety packing by inserting a permanent magnet.

BRIEF SUMMARY OF THE INVENTION

The aim of the invention is to provide a safety packing of the above-mentioned type wherein the disadvantages of the known safety packing are overcome.

This aim is reached according to the invention in that the locking mechanism is provided with an opening and the retainer can therefore only be moved from the retaining position to the release position in such a way that this may only occur using a magnetic force generated by a magnet or a magnetized element being located in the opening.

It is thereby achieved that an arbitrary permanent magnet cannot be used to shift the locking element to the released position. Instead, a suitable magnet must satisfy specific requirements with respect to the shape and magnetic force thereof in order to be able to move the locking element. The shape is important in order to fit into the opening of the locking mechanism, whereas when the magnetic band fits into the opening, the right magnetic field strength must also still be generated relative to the direction and orientation in order to move the retainer.

BRIEF DESCRIPTION OF THE DRAWINGS

Other features and advantages of the invention will become apparent from the following description referring to the accompanying drawings, wherein.

DETAILED DESCRIPTION OF THE INVENTION

Figure 1:
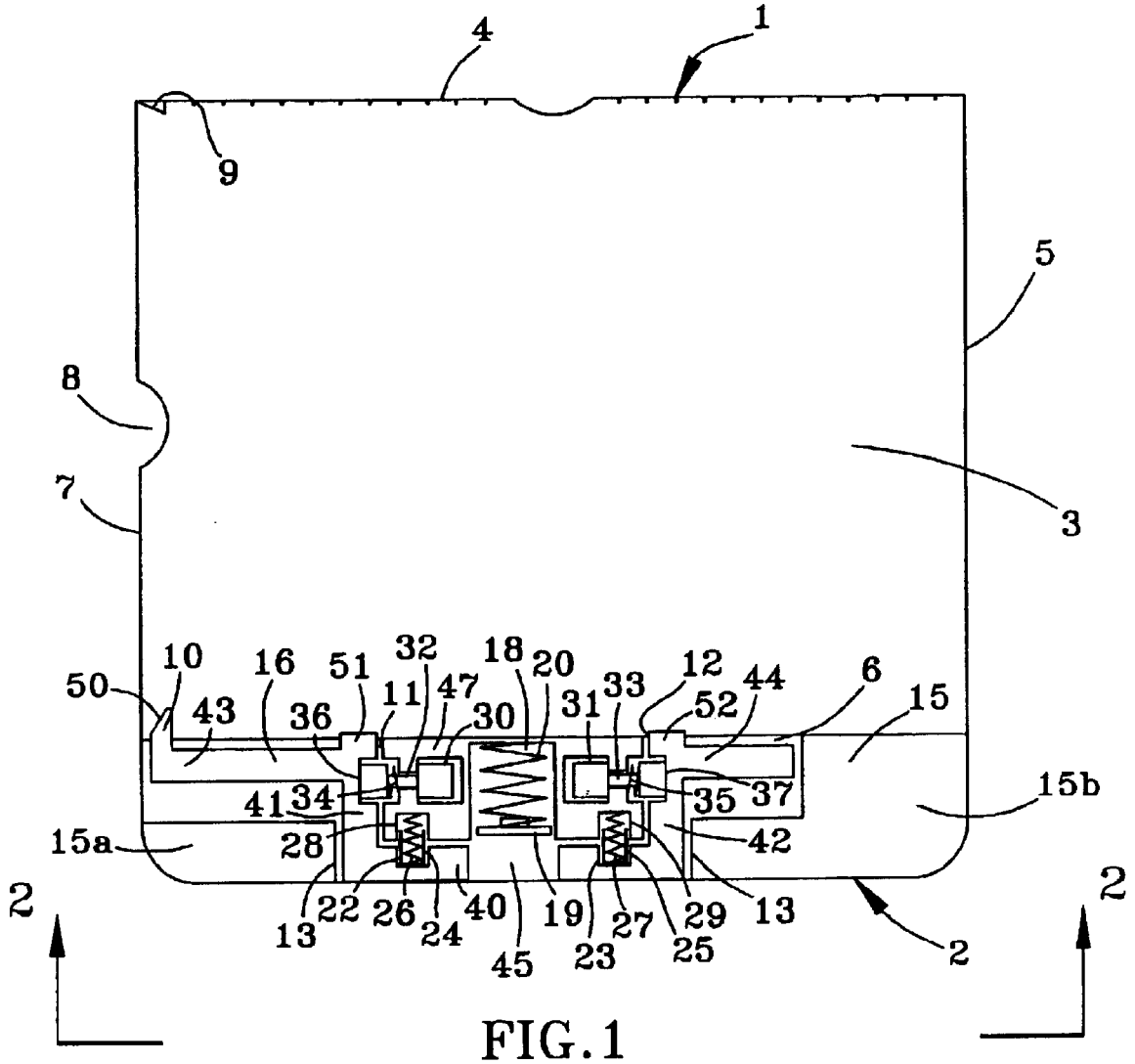
FIG. 1 is a schematic section of a safety packing for CD packing according to the invention.
Figure 2:
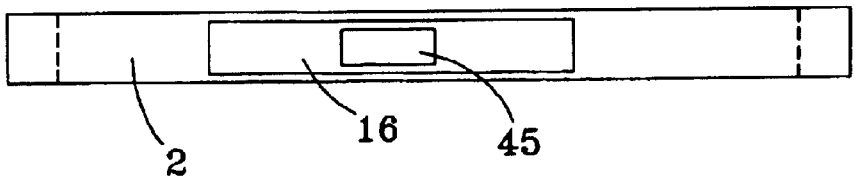
FIG. 2 is a side view of the packing according to FIG. 1.

FIGS. 1 and 2 show a CD packing according to the invention, which comprises a housing 1 and a locking mechanism 2. The housing 1 is not shown in detail, but generally is in the shape of a rectangular parallelepiped, with a flat rear wall 3 and a (non shown) flat front wall, an upper wall 4, a side wall 5 and a bottom wall 6. The side 7 lying opposite the side wall 5 is opened so that a CD can be inserted herein. Recesses 8 are arranged in the front wall and in the rear wall 3 in order to facilitate the removal, so that an inserted CD can be grabbed with fingertips.

The above-mentioned walls define a rectangular space in which a CD packing fits with a limited tolerance. The upper wall 4 is castellated on the side of the space, whereby a CD packing being pressed against the wall 4 cannot be any longer moved laterally, as such packings are also provided with castellated walls. Moreover, the wall 4 near the opened side 7 is provided with an abutment 9 extending in the direction of the space 3.

The bottom wall 6 is connected with the locking mechanism 2 and is provided with a number of openings 10, 11 and 12, the function of which will be described hereafter.

The locking mechanism 2 comprises a frame part 15 which is securely connected with the housing 1 and a locking element 16 which is slidable within this frame part 15. The frame part 15 comprises a front wall and a rear wall which actually extend the front wall and the rear wall 3 of the housing and therefore form an assembly.

The front wall and the rear wall of the frame part 15 are connected with each other through parts 15A, 15B which form a seal for the sides and the bottom sides of the frame part 15 and which also form a guide 13 for the locking element 16, so that it can shift to and fro, from and to the housing 3. The front wall and the rear wall of the frame part 15 are moreover connected through a central part 17. The central part is provided, approximately at mid-way of the bottom edge of the assembly, with an opening 18 which extends from the bottom edge to the vicinity of the bottom wall 6. An abutment 19 is arranged in this opening 18, which abutment is pressed through spring 20 in the direction of the bottom edge, but is retained by an edge in the locking element 16 as it will be described hereafter.

In the bottom edge oriented side of the central part 17, two blind openings 22, 23 are additionally provided and respective pins 24, 25 are provided in each of them, which are pressed through springs 26, 27 in the direction of the bottom edge.

The pins 24, 25 cooperate at their other end with blind bores 28, 29 in the locking element 16, as it will be described hereafter.

Each side edge oriented side of the central part 17 is moreover provided with a blind bore 30, 31. A plunger 32, 33 is located inside, which is pressed through springs 34, 35 in the direction of the side edge and can thereby cooperate with a blind bore 36, 37 formed in the locking element 16, as it will be described hereafter.

The locking element 16 comprises a basic part 40, upright arms 41, 42 and two wings 43, 44. The upright arms 41, 42 are connected with both ends of the basic part and are perpendicular thereto, whereas each wing 43, 44, is connected with an upright arm 41, 42 and is perpendicular thereto, as it is clearly seen from FIG. 1.

The basic part 40 comprises an opening 45 which, when the locking element 16 is arranged in the frame part 2, is in alignment with the opening 18, but with a somewhat smaller section so that the abutment 19 cannot pass through the opening 45.

The basic part 40 also comprises both blind bores 28, 29 which cooperate with the pins 24, 25.

The upright arms 41, 42, together with the basic part 40, are adapted to the shape of the guide 13 and ensure that the locking element can shift controllably to and fro from and to the housing 3. In the sides oriented to each other of the upright arms 41, 42 the blind bores 36, 37 are provided, cooperating with the plungers 32, 33. The wing 43 is provided with an abutment 51 which fits through the opening 11 in the bottom wall 6 and the wing 44 is provided with an abutment which fits through the opening 12 in the bottom wall 6. The wing 43 is moreover provided with an abutment 50 which fits through the opening 10 in the bottom wall 6.

The safety packing works as follows.

In FIG. 1 the packing is shown in the closed position, i.e. with a CD packing present in the housing being locked inside through the action of the abutments 50, 51, 52, whereby the abutment 50 grabs behind the CD packing and the abutments 51, 52 cooperate with openings which are present as a standard in CD packings, by means of the castellated upper wall 4 against which the CD packing is pressed, and finally by the abutment which maintains the CD packing near the upper wall 4.

To remove a CD packing from the housing, a magnetic bar or a magnetized bar is pressed into the openings 45 and 18, shifting thereby the abutment 19 in the direction of the housing 1 until it entirely lies against the bottom of the opening 18.

At this time, the magnetic bar can attract the plungers 32, 33, which are made in a magnetized material, against the load of the springs 34, 35. The plungers are released from the blind bores 36, 37 and the locking element 16 can now move freely and will be pressed away from the housing 1 as a result of the action of the springs 26, 27. The abutments 50, 51 are released from the CD packing in the housing 1 and the CD packing is released from the wall 4 and this latter can now be removed from the housing. The magnetic bar is removed from the opening 18 and the safety packing is ready for a new use.

A new CD packing can thereby be slid into the housing 1 through the opening 7 and when pushing the locking element in the direction of the housing, this one may be locked therein. This occurs automatically after the locking element has been clamped sufficiently away so that the plungers 32, 33 are pushed back in the blind bores 36, 37. The assembly is now again in the situation illustrated in FIG. 1.

FIGS. 1 and 2 illustrate the opening 18 and the associated insertion opening 45 as a rectangular opening. In order to make any possible fraud difficult, these openings, at least certainly the opening 45, may have a special shape so that no any magnetic bar can be inserted therein, but exclusively specially formed magnetic bars, for example with a S-shaped section, can be used. The assembly works then as the combination of a key and a keyhole.

In another embodiment, the mobility of the locking element is controlled in so that the locking element is pressed outside by the springs 26, 27 in such a way that the plungers 32, 33 lie somewhat biased in the bores 36, 37 and have therefore a clamping effect. The magnetic force of an inserted magnetic bar is then sufficient to remove the plungers 32, 33. This can only happen when the locking element is simultaneously pushed somewhat in the direction of the housing 1 so that the plungers 32, 33 are released in the bores 36, 37 and are therefore attracted by the magnetic bar.

Figure 3:
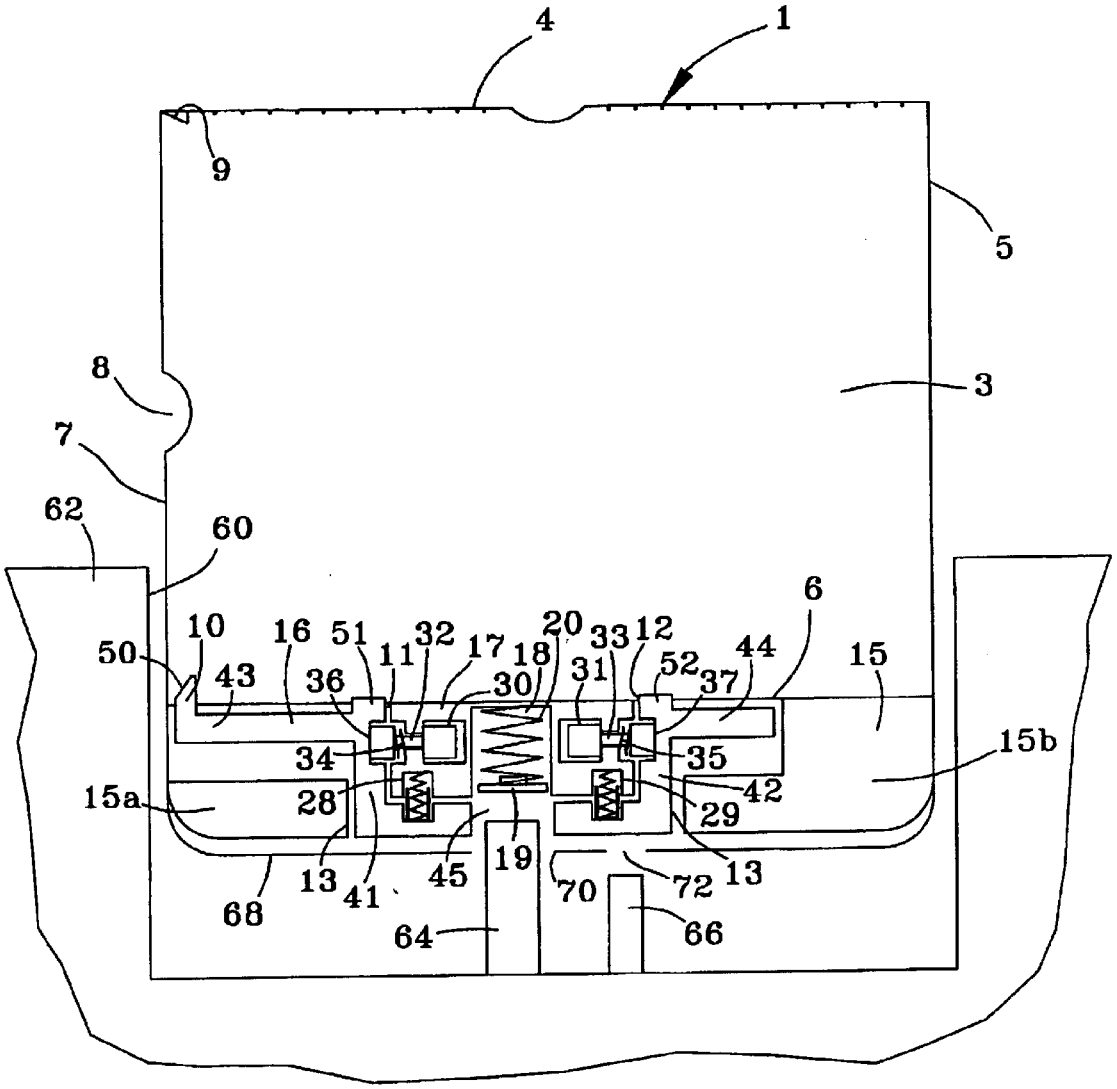
FIG. 3 is a schematic section of a safety packing according to a second embodiment of the invention.

In practice, this can be automatically achieved by providing a slot 60 in the surface of a counter 62 for receiving the safety packing, as represented in FIG. 3. A magnetic bar 64 and optionally a small embossment (pressing element) 66 are shown as provided within the slot 60. When the safety packing is properly inserted into the slot 60, the magnetic bar 64 is automatically inserted in the openings 18 and 45 and the embossment 66 automatically presses the locking element 16 in the direction of the housing 1. Moreover, mechanically pressing may be further complicated by completely closing the bottom edge of the locking mechanism 2 with a wall 68 connected to the frame part 15, as also represented in FIG. 3. An opening 70 is present in the wall 68 for inserting the magnetic bar 64, and additionally a second opening 72, also having possibly a special profile for receiving the embossment 66, is present to press the locking element 16 somewhat in the direction of the housing 1. Finally it is also still possible to manufacture the system in such a way that each plunger 32 and 33 is controlled by a separate magnetic bar, making fraud more difficult as two magnetic bars would be used simultaneously, each also having possibly a special section and being possibly combined with a mechanical pushing action.

It should be apparent that the invention is not limited to the described and illustrated embodiment, but several modifications can be contemplated within the scope of the claims. This is specially true for the mechanical parts such as springs and pins and the shaping of the different components.

What is claimed is:

1. A safety packing for a product to be exhibited, the safety packing comprising:

a housing with an opening through which the product can be inserted into and removed from the safety packing; and a locking mechanism associated with the housing for preventing removal of the product from the housing through the opening, the locking mechanism comprising:

a frame connected to the housing;

a locking element received in the frame, the locking element being movable between a locking position where the product is prevented from being removed from the housing through the opening, and an open position where the product can be moved into and from the housing through the opening;

means for generating a force that urges the locking element toward the open position;

a retainer within the frame and movable between a retaining position and a release position, the retainer being operable to secure the locking element in the locking position when the retainer is in the retaining position, the retainer being movable towards the release position through application of a magnetic force so as to release the locking element from the locking position;

means for biasing the retainer toward the retaining position; and an opening in the locking mechanism for receiving a magnetic element operable to generate the magnetic force and move the retainer from the retaining position to the release position.

2. A packing according to claim 1, further comprising the magnetic element, wherein the opening in the locking mechanism and the magnetic element have complementary shapes.

3. A packing according to claim 1, wherein the locking element is movable in a first direction, and the retainer comprises a pin movable in a second direction substantially perpendicular to the first direction.

4. A packing according to claim 3, wherein the frame has a recess in which the pin is received when the retainer is in the retaining position, the force generating means causes the pin to be frictionally retained in the recess, and the locking element is required to be moved counter to the force generated by the force generating means to enable the magnetic force of the magnetic element to draw the pin from the recess.

5. A packing according to claim 4, wherein the locking mechanism comprises a second opening through which the locking element can be accessed and moved counter to the force generated by the force generating means.

6. A packing according to claim 5, further comprising a pressing element receivable in the second opening of the locking mechanism, wherein the pressing element and the second opening have complementary shapes.

7. A safety packing system for a CD package, the safety packing system comprising:

a housing with an opening through which the CD package can be inserted into and removed from the safety packing;

a frame connected to the housing;

a locking element mounted in the frame, the locking element being movable within the frame between a locking position where the CD package is prevented from being removed from the housing through the opening, and an open position where the CD package can be moved into and from the housing through the opening;

means for generating a force that urges the locking element toward the open position;

an opening in the frame;

a magnetic element receivable in the opening of the frame; a retainer mounted in the frame, the retainer being biased toward a retaining position and movable to a release position, the retainer being operable to secure the locking element in the locking position when the retainer is in the retaining position and to release the locking element when the retainer is in the release position, the retainer being movable towards the release position through application of a magnetic force by the magnetic element when received in the opening of the frame so as to release the locking element from the locking position and cause the locking element to move to the open position in response to the force generating means.

8. A safety packing system according to claim 7, wherein the magnetic element and the opening in the frame have complementary cross-sectional shapes.

9. A safety packing system according to claim 7, wherein the locking element is movable in a first direction, and the retainer is movable in a second direction substantially perpendicular to the first direction.

10. A safety packing system according to claim 7, wherein the frame has a recess in which the retainer is received when in the retaining position, the force generating means causes the retainer to be frictionally retained in the recess, and the locking element is required to be moved counter to the force generated by the force generating means to enable the magnetic force of the magnetic element to draw the retainer from the recess.

11. A safety packing system according to claim 10, wherein the frame comprises a second opening through which the locking element can be accessed and moved counter to the force generated by the force generating means.

12. A safety packing system according to claim 11, further comprising a pressing element receivable in the second opening of the frame, wherein the pressing element and the second opening have complementary cross-sectional shapes.

* * * * *

UNITED STATES PATENT AND TRADEMARK OFFICE

CERTIFICATE OF CORRECTION

PATENT NO. : 6,732,861 B2
DATED : May 11, 2004
INVENTOR(S) : Mathieu Aarts

It is certified that error appears in the above-identified patent and that said Letters Patent is hereby corrected as shown below:

Title page,
Item [73], Assignee, should read -- Safeframe BV, at Rosmalen, Netherlands --.

Signed and Sealed this

Twenty-second Day of November, 2005

JON W. DUDAS
*Director of the United States Patent and Trademark Office*